US005357886A

United States Patent [19]

Piller

[11] Patent Number: 5,357,886

[45] Date of Patent: Oct. 25, 1994

[54] APPARATUS FOR THE PRODUCTION OF TUFTING MATERIAL

[76] Inventor: Helmut Piller, Clara-Hätzler-Str. 5, D-8900 Augsburg, Fed. Rep. of Germany

[21] Appl. No.: 98,604

[22] Filed: Jul. 28, 1993

[30] Foreign Application Priority Data

Aug. 5, 1992 [DE] Fed. Rep. of Germany ..... 4225859
Nov. 28, 1992 [DE] Fed. Rep. of Germany ..... 4240134

[51] Int. Cl.[5] ..... D05C 15/12; D05C 15/14

[52] U.S. Cl. ..... 112/80.4; 112/80.01; 112/80.55

[58] Field of Search ..... 112/80.01, 80.3, 80.5, 112/80.55, 80.57, 80.4, 163, 164, 165, 166, 167, 197, 199

[56] References Cited

FOREIGN PATENT DOCUMENTS 1785451 2/1971 Fed. Rep. of Germany ... 112/80.01
821702 10/1959 United Kingdom ..... 112/80.01

*Primary Examiner*—Clifford D. Crowder
*Assistant Examiner*—Paul C. Lewis
*Attorney, Agent, or Firm*—Harrison & Egbert

[57] ABSTRACT

In the case of an apparatus for the production of textile pile fabric, and preferably for the production of two bilaterally symmetrical webs of textile pile fabric, comprising a conveying device, able to be driven in steps, for at least one taut support fabric web, with at least one tufting needle bar extending athwart the direction of web conveyance and which bears a plurality of tufting needles placed with a mutual spacing and is able to be moved transversely in relation to the plane of web conveyance, the tufting needdles entraining one respective pile thread and piercing each support fabric web to form a pile thread loop and a loop holding device which is adapted to be reciprocated, is arranged opposite to the tufting needle bar, plunges into the pile thread loops, and preferably places a binding thread therein and in the case of the production of two bilaterally symmetrical textile pile fabrics the conveying device receives two support fabric webs held taut with a distance apart equal to the sum of the individual pile heights and a cutting device is provided at the delivery end of the apparatus in a part between the two support fabric webs for separating the same, it is possible achieve a high pile density and nevertheless a solid design and a straightforward arrangement of the engagement members if each tufting needle bar possesses at least one row of tufting needles extending obliquely in relation to the direction of web conveyance with a plurality of tufting needles arranged obliquely one behind the other and a common engagement member of the loop holding device is associated with each such row of tufting needles, the stroke of such member in the longitudinal direction of the row being at least equal to the length of the associated tufting needle row.

14 Claims, 5 Drawing Sheets

APPARATUS FOR THE PRODUCTION OF TUFTING MATERIAL

BACKGROUND OF THE INVENTION

The invention relates to an apparatus for the production of textile pile fabric, and preferably for the production of two bilaterally symmetrical webs of textile pile fabric, comprising a conveying device, able to be driven in steps, for at least one taut support fabric web, with at least one tufting needle bar extending athwart the direction of web conveyance and which bears a plurality of tufting needles placed with a mutual spacing and is able to be moved transversely in relation to the plane of web conveyance, the tufting needles entraining one respective pile thread and piercing each support fabric web to form a pile thread loop and a loop holding device which is adapted to be reciprocated, is arranged opposite to the tufting needle bar, plunges into the pile thread loops, and preferably places a binding thread therein, in the case of the production of two bilaterally symmetrical textile pile fabrics the conveying device receiving two support fabric webs held taut with a distance apart equal to the sum of the individual pile heights and a cutting device is provided at the delivery end of the apparatus between the two support fabric webs for separating the same.

The German patent publication 1,785,451 B discloses an apparatus of this type for the production of two bilaterally symmetrical webs of velvet fabric, there being two support fabric webs held taut with a distance apart equal to the sum of the individual pile heights and received on the conveying device and a cutting device is provided at the delivery end of the apparatus between the two support fabric webs. In the case of this known apparatus a separate gripper is associated with each of the rows of tufting needles extending at a right angle to the direction of conveying of the web. The tufting needles arranged adjacent to one another in the direction of the breadth of the support fabric web must consequently be spaced so far apart that the grippers associated with them may be accommodated without the danger of colliding with each other. This makes a relatively large spacing of the tufting needles necessary, something which is a limiting factor as regards the density of the distribution of the tufting threads.

SHORT SUMMARY OF THE INVENTION

One object of the invention is therefore to improve upon an apparatus of the type initially mentioned with such simple and inexpensive means that a dense distribution of the tufting threads is rendered possible.

In order to achieve these and/or other objects appearing from the present specification and claims each tufting needle bar possesses at least one row of tufting needles extending obliquely in relation to the direction of web conveyance with a plurality of tufting needles arranged obliquely one behind the other and a common engagement member of the loop holding device is associated with each such row of tufting needles, the stroke of such member in the longitudinal direction of the row being at least equal to the length of the associated tufting needle row.

These measures lead to the advantageous result of a large space for the construction of the loop holding device. This space left free is advantageously not limited to the lateral distance between the individual tufting needles from one another and in fact the projection, as seen in the conveying direction, of the full tufting needle row is available. For the design of the loop holders it is hence possible to employ comparatively sturdy parts, which ensure reliability and a long working life even under rough conditions of use and heavy mechanical loads. The large amount of space for the accommodation of the loop holding device leads to the advantage of a straightforward arrangement and good accessibility, something which can aid servicing and maintenance. Despite the large amount of space for the loop holding device it is however possible for the distances between the individual tufting needles to be comparatively small. This distance is equal to only a fraction of the length of the row, important for the space occupied by the loop holders, or, respectively, the projection thereof as seen in the conveying direction. Owing to the comparatively small tufting needle spacing there is the advantage of being able to attain an extremely dense distribution of the tufting threads.

Advantageous developments and convenient further design features of the invention are recited in the claims. Thus it is convenient to provide a plurality of parallel tufting needle rows, which are evenly offset in relation to each other, on each tufting needle bar, there being a common engagement member of the loop holding device associated with each of the same. The lateral distance between the loop holders is in this case advantageously equal to the spacing between the rows, which is substantially larger than the needle pitch. Owing to the distribution of the needles provided in the present case over the width of the web in a plurality of parallel rows running obliquely in relation to the conveying direction of the web, there is the advantageous possibility of also limiting the necessary space. The said measures accordingly render possible. despite the small needle pitch and the large space for the loop holding device, furthermore a comparatively compact manner of construction.

Despite a simple manner of design the invention renders possible the advantage of a high rate of output. Using the features of the invention it is in fact readily possible to so design the support fabric web conveying device that one respective advance step corresponds to the desired tufting thread distance in the finished product. By the same token it is advantageously possible for the needle spacing as seen in the conveying direction to also correspond to the mutual distance between tufting threads in the finished product.

In accordance with a further advantageous development of the invention it is possible for the engagement member, associated with each one respective tufting needle row, of the loop holding device to be designed in the form of lance extending in the longitudinal direction of the row and parallel to the support fabric web. In this respect it is advantageously a question of a sturdy component with a high inherent strength. There is consequently the advantage of being able to serve comparatively long rows of tufting needles without any danger.

It is convenient furthermore if the engagement not only associated with several rows, arranged adjacent to one another, of tufting needles, of the loop holding device are arranged on a common bar extending transversely in relation to the direction of web conveyance and which is guided for movement in the longitudinal direction of the row. These features render possible a common actuation of the all loop holders together, something which can simplify the design.

More particularly in the case of the production of two bilaterally symmetrical fabrics the tufting thread loops preferably have a binding thread placed in them. The engagement members employed for this purpose, each carrying a binding thread, of the loop holding device, which may be simply designed in the form of needle-like lances, may advantageously be provided with an associated binding thread catcher arranged adjacent to the front dead center point of the lance tip. These features lead to a reliable formation of binding thread loops and consequently to high operational reliability. Since for each engagement member and accordingly for each row of tufting needles in each case only one binding thread catcher is required, there is the advantage in this respect as well of a relatively large distance, something which leads to a straightforward, sturdy manner of design.

Further convenient developments and advantageous modifications of the invention are recited in the claims.

Further details and forms of the invention will be understood from the following detailed descriptive disclosure of one preferred embodiment thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
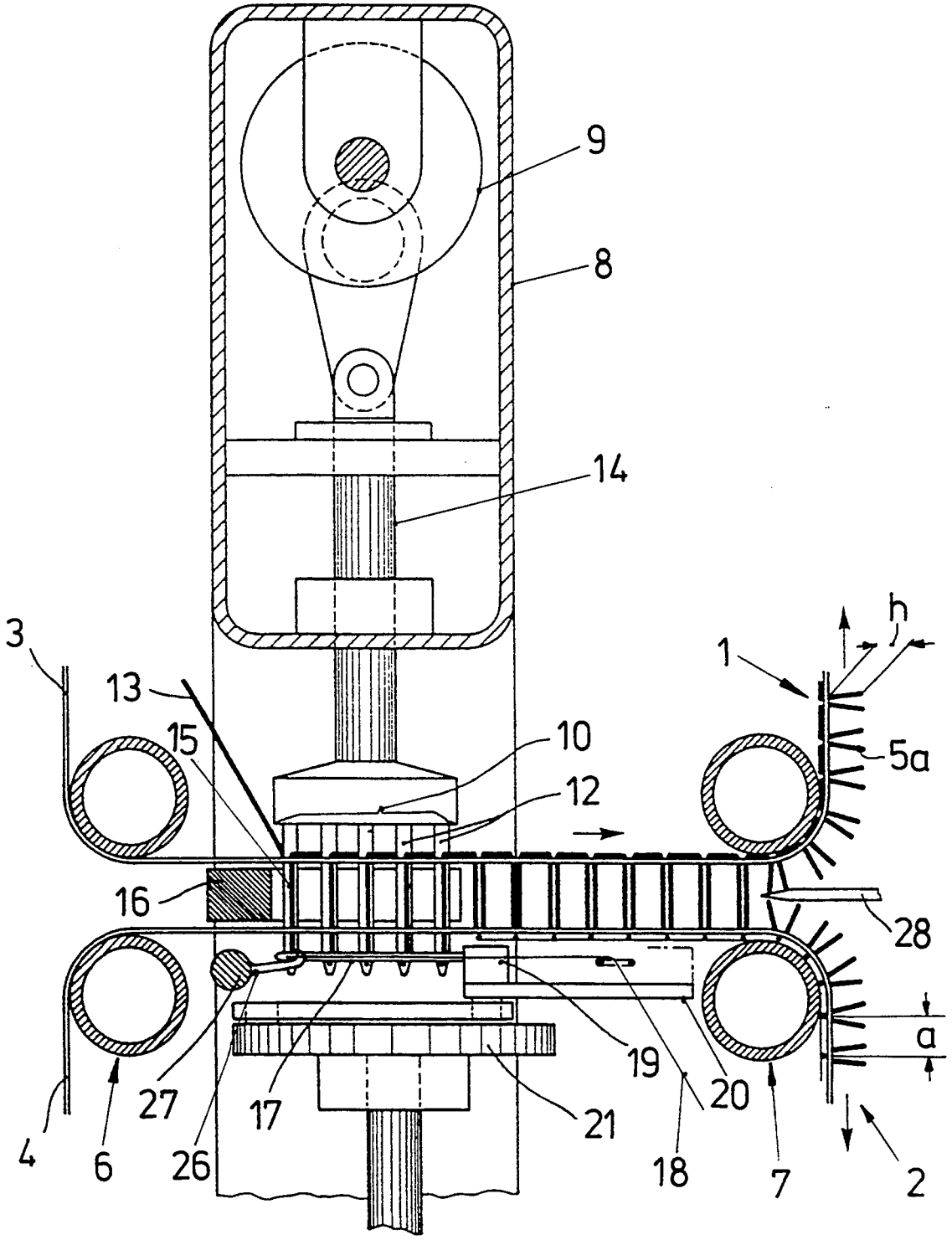
FIG. 1 is a longitudinal section taken through a double tufting machine in accordance with the invention as seen in a diagrammatic representation.

The double tufting machine depicted in the drawing makes possible, as best shown in FIG. 1, the simultaneous production of webs 1 and 2 of velvet material. These webs consist in a known manner of a support fabric web 3 and 4 in which threads 5*a* are stitched, which appear as the pile with, in the present case, the same height h. The threads 5*a* are arranged at positions of piercing spaced apart by the distance a. In the part between the two pairs of rolls the two fabric webs 3 and 4 are guided in a taut parallel state. The clearance distance between them is equal to the sum of the heights of the two individual piles, in the present case equal to twice the height h. The stepped drive of the conveying device is such that one step is equal to the distance a.

Figure 2:
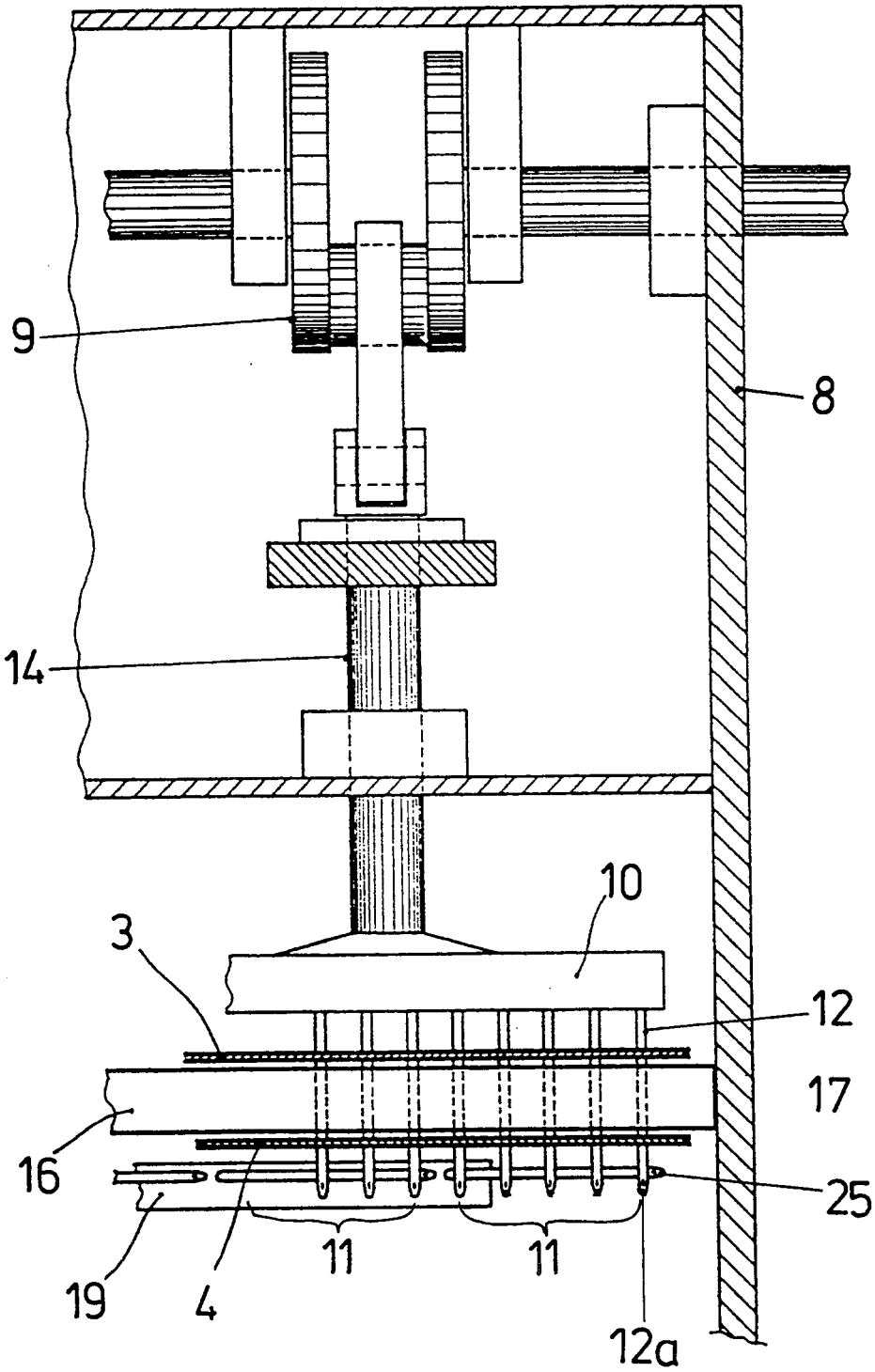
FIG. 2 is a cross section taken through the arrangement in accordance with FIG. 1.
Figure 3:
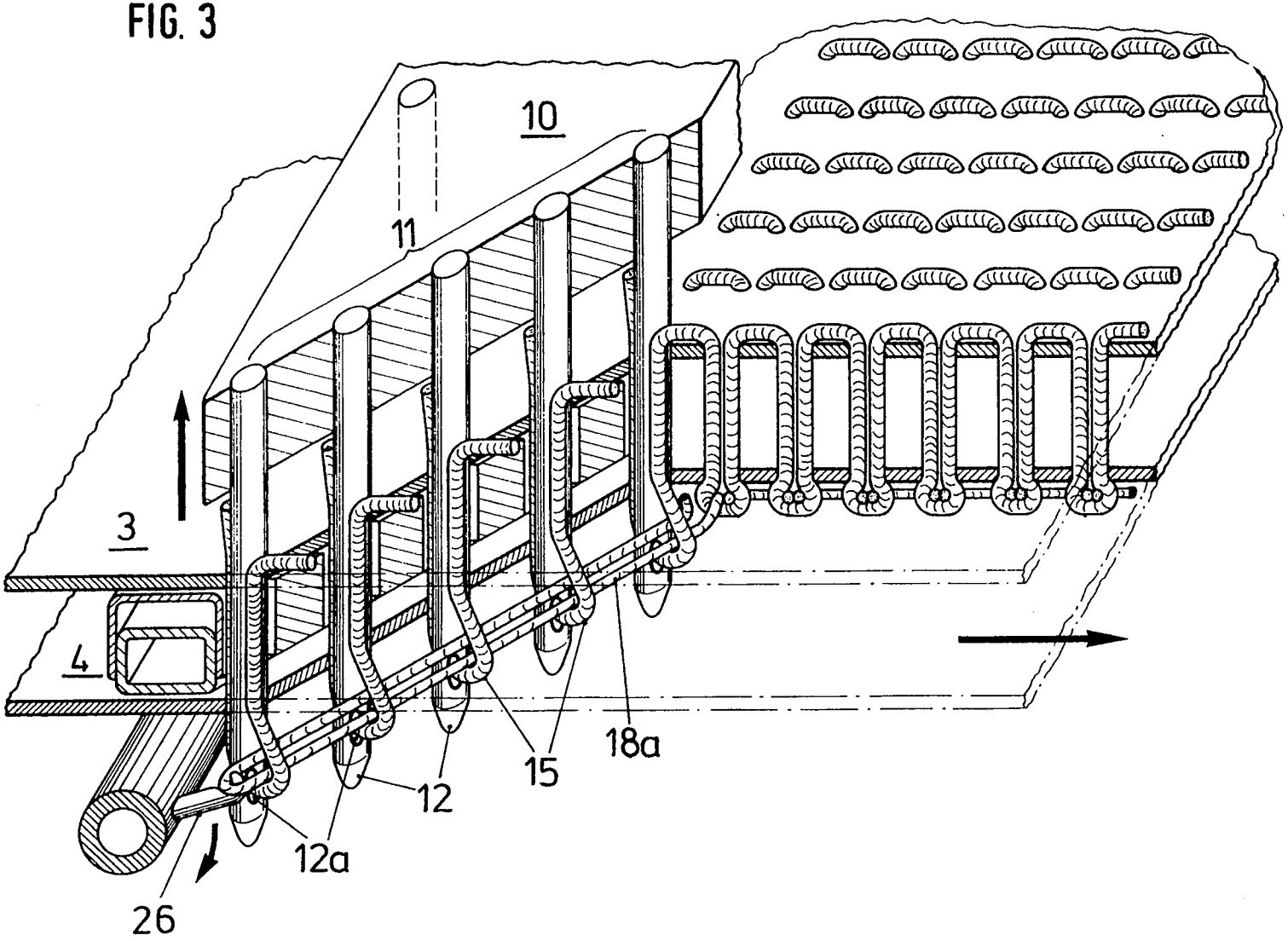
FIG. 3 is a sectional view, on a greater scale, adjacent to a row of tufting needles.

In the part between the two pairs 6 and 7 of rolls there is, as shown in FIGS. 1 and 2 furthermore, a tufting needle bar 10 able to be reciprocated vertically by means of a crank drive 9 and which extends right across the width of the web and is mounted by means of a crosspiece of the machine frame 8, such bar 10 bearing a plurality of rows 11 of tufting needles 12, which are arranged in the manner described in following, which needles at their front ends each possess an eye 12*a* and each carry a so-called pole or tufting thread 13, which in the unsevered condition described in following presents the threads 5*a* appearing as the pile. The stroke of the tufting needle bar 10 is produced by a plurality of guide rods 14, which are distributed over the width, in a direction perpendicular to the conveying plane of the support fabric webs 3 and 4 and is of such a size that the tufting needles 12 each run through both support fabric webs 3 and 4, the entrained tufting threads 13, as shown in FIG. 3, forming loops 15. In order to prevent a deflection of the support fabric webs 3 and 4 in the part between the pairs of rolls 6 and 7 and coming into engagement with the tufting needles 12, the tufting needle bar 10 has an associated spacer 16 which is arranged in the part between the two parallel drive support fabric webs 3 and 4, such spacer here being in the form of a solid rail, past which the tufting needles 12 move. Instead of one tufting needle bar extending right over the width of the web it is possible to have a plurality of bar sections driven synchronously with each other.

In order to ensure that the loops are not pulled out during backward motion of the tufting needles 12, a loop holding device is provided underneath the lower support fabric web 4, such loop holding device having individual loop holders associated with the individual rows 11 of tufting needles, in the form of engagement members 17 which are parallel to the web and are able to be reciprocated, which member 17 enter the loops 15 at the end of the downward motion of the tufting needle 12 and secure such loops against being pulled open. The engagement members 17 may respectively carry a lower thread functioning as a binding thread 18, which as shown in FIG. 3 also, like the lower thread of a sewing machine, secures in position the loops 15 during the upward stroke of the tufting needles 12 on the lower side of the lower support fabric web 4. At the end of the upward stroke of the tufting needles 12 the conveying device is put into operation, an advance by one step taking place. The engagement members 17 can, as shown in FIG. 1, be mounted on a bar 19 extending right across the width of the web, such bar running in a longitudinal guide 20 in parallelism to the web and being driven by a crank drive 21. Instead of a bar 19 extending right the way across the width of the web it is naturally possible to have a plurality of preferably synchronously driven bar sections arranged adjacent to each other.

Figure 4:
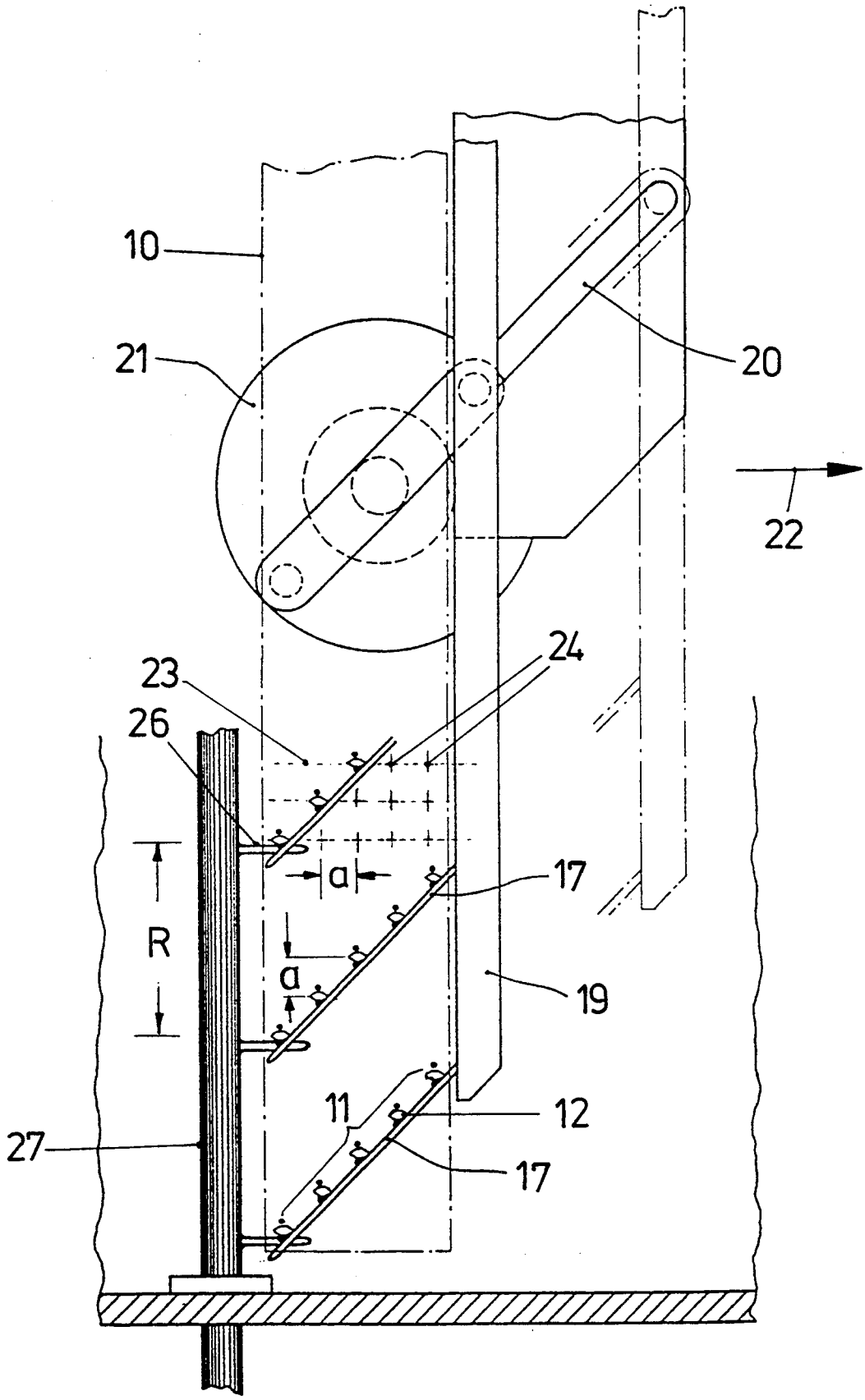
FIG. 4 is an elevation of the arrangement in accordance with FIG. 1 as seen from below.

The tufting needle bar 10 bears, as best shown in FIG. 4, a plurality of rows 11 of tufting needles, with an even distribution across the width of the web and extending obliquely in relation to the conveying direction of the web, which rows 11 comprise a plurality of tufting needles 12 arranged obliquely behind each other. The inclination of the tufting needle rows 11 in relation to the conveying direction of the web as indicated by the arrow 22 in FIG. 4 is equal to 45° in the present case, this leading to the same projection lengths of the tufting needle rows 11 in relation to the length and width of the web and consequently renders possible an extremely compact arrangement. The width of the tufting needle bar 10 in the length direction of the web is so selected that, it is at least equal to the projection length of the tufting needle rows 11 as seen transversely to the length direction of the web.

In the illustrated working embodiment of the invention each tufting needle row 11 comprises five tufting needles 12, which in the present case are set obliquely at 45° to the direction of movement of the web, one behind the other. Each tufting needle 12 produces in operation stitches 24 on a track 23 extending in the conveying direction shown in broken lines in FIG. 4, the distance between the stitches being respectively equal to one step of the advancing motion, that is to say the distance a. Furthermore the mutual distance between the tufting needles 12 arranged behind each other is such that the projection as seen in the direction of conveying is also equal to the distance a. In order to render possible an equal distribution of tracks over the full width of the web, the row spacing R, as seen in the direction of the web width, of the individual tufting needle rows 11 is equal to the projection of their length as seen in the conveying direction plus one needle spacing.

The tufting needles 12 of each tufting needle row 11, as shown in FIG. 4 as well, have an associated common engagement member 17, this leading to a mutual spacing, corresponding to the distance R between rows, between the engagement members 17. Despite an extremely small thread spacing a and hence an extremely high pile density it is consequently possible to attain a very large distance between the engagement members 17 in the present case so that a straightforward arrangement and ready accessibility is possible together with a solid design of the engagement members. The engagement members 17 inclined obliquely in relation to the direction of conveying of the web are in the present case set like combs on the bar 19 extending continuously over the web width. The bar 19 runs perpendicularly to the direction of conveying of the web. The associated longitudinal guide 20 however extends in parallelism to the direction of the tufting needle rows 11, which extend obliquely to the direction of conveying of the web so that by means of the crank drive 21 it is possible to achieve a motion of the engagement members 17 parallel to the rows. The stroke of the bar 19 and accordingly furthermore the engagement members 17 mounted thereon is in the present case somewhat greater than the length of the tufting needle rows 11 so that the engagement members 17 are able to be brought into and out of engagement with all tufting needles 12 of the respectively associated tufting needle row 11 or, respectively, the loops 15 produced by the tufting needles 12. In FIG. 4 the complete loop holding device is illustrated with full lines in the front end position and shown in broken lines in the rear end position.

The engagement members 17 are in this case designed as lances extending parallel to the support fabric web and in the longitudinal direction of the rows, the length of the members 17 being at least equal to the stroke of the associated bar 19. In cases like the present one, in which the engagement members 17 carry one respective binding thread 18, the said lances are designed like needles, that is to say like the tufting needle 12 near the front end thereof, with an eye 25. In those cases in which it is possible to do without a binding thread, it is only the lance-shaped engagement members which come slip into the loops during the backward stroke of the tufting needles 12.

The binding thread 18 carried in the illustrated working embodiment by the engagement members 17 constitutes, as shown in FIG. 3 furthermore, because of the reciprocating motion of the engagement members 17 a respective binding thread loop 18*a*. In order to hold such loop during the backward motion of the engagement members 17, each engagement member 17 has, as shown in FIGS. 1, 3 and 4 as well, an associated binding thread catcher 26, which is arranged underneath the lower support fabric web 4. The binding thread catchers 26, which are respectively able to be brought into engagement with the front end of the respectively associated binding thread loop 18*a*, are arranged adjacent to the front dead center position of the front end of the respectively associated engagement member 17. In the illustrated working embodiment of the invention the binding thread catchers 26 are simply designed in the form of pivotally arranged hooks, which hold the binding thread 18 during the return stroke of the lance constituting the respectively associated engagement member 17. The binding: thread catchers 26 associated with the engagement members 17, which are distributed over the width of the web, are practically arranged along a line at a right angle to the direction of conveying of the web. All binding thread catchers 26 arranged over the width of the web with the same distribution as the distribution of the engagement members 17 are in this case received on a carrier 27 extending continuously over the width of the web, such carrier being simply designed in the form of a pivotal shaft, which can be coupled with a pivotal drive (not illustrated). It is naturally as well for there to be a plurality of carrier sections arranged adjacent to each other.

Figure 5:
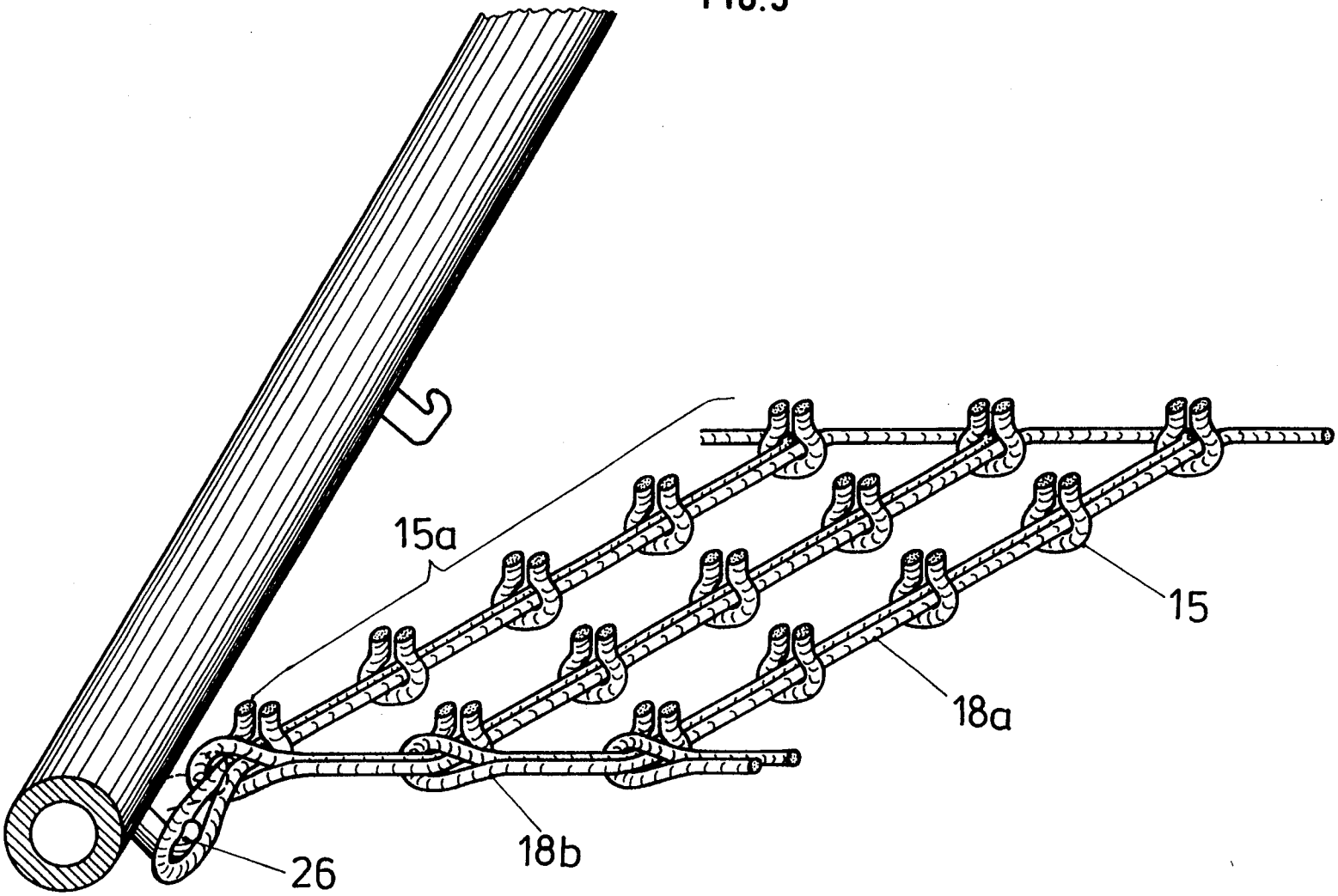
FIG. 5 is a diagrammatic elevation of the mutually engaging tufting thread and binding thread loops on a larger scale.

In order to protect the binding thread loops 18*a* against being pulled out by the engagement members 17 it is possible for the latter, as shown in FIG. 5, to have their front, eye-shaped end 18*a* to be brought into engagement with the respectively adjacent binding thread loop, which is staggered by one advance step a. This loop functions accordingly as retaining means associated with the engaged binding thread loop. The tufting needle loops 15 produced by the tufting needles 12, constitute rows 15*a* corresponding to the tufting needle rows 11, the rows 15*a*, which are relatively staggered by one advancing step corresponding to consecutive strokes of the associated tufting needle row 11. In order to provide for the desired fixation it is possible for the binding thread catchers 26 to be simply so designed and arranged that they deflect the respectively engaged binding thread loop 15 of the associated row 15*a* so far transversely in relation to the longitudinal direction of the row that the deflected, eye-like end 18*b* assumes a position, during the next stroke of the tufting needle row 11, adjacent to the foremost tufting thread loop 15 of the tufting thread row 15*a* then produced, and accordingly has the associated engagement member 17 run through it during the forward stroke of the engagement members 17. The binding thread carried by the latter is accordingly also laid in the deflected end 18*b* and then deflected by means of the associated binding thread catcher in the manner described in the above.

Following the web part coming into engagement with the tufting needles 12 the two support fabric webs 3 and 4, as shown in FIGS. 1 and 3 as well, are connected together by the loops 15 which have been drawn closed. In order to create two bilaterally symmetrical pieces of velvet material the support fabric webs 3 and 4 connected together are separated from one another by means of a cutting device 28 arranged adjacent to the pair 7 of rolls on the delivery side, which cutting device may simply be designed in the form of a stationary or oscillating knife, which severs the tufting threads and consequently forms the pile threads 5*a*. In the illustrated working embodiment of the invention the cutting device 28 is mounted in the middle of the gap so that there are equal pile heights h. It is naturally possible to have an arrangement not in the middle. Instead of a blade-like cutting member it is naturally possible to have a rotary cutting means.

Although the above account has been restricted to one preferred working embodiment of the invention, this has not been with the intention of limiting the invention thereto. In fact a man in the art will have available a large number of possibilities in order to implement the common inventive principle and in order to adapt to particular circumstances of an individual case. For instance the invention might be employed for the production of pile material in one web. In this connection as well the features of the invention can be utilized to attain an extremely dense pile thread distribution.

I claim:

1. An apparatus for the production of textile pile fabric comprising:

a conveying means driveable in steps for positioning at least one taut support fabric web, said conveying means having at least one tufting needle bar extending athwart a direction of web conveyance, said tufting needle bar bearing a plurality of spaced-apart tufting needles, said tufting needles movable transversely in relation to a plane of web conveyance, the tufting needles entraining one respective pile thread at a time and piercing said at least one support fabric web to form a pile thread loop;

a loop holding means arranged opposite to the tufting needle bar, said loop holding means for reciprocating into the pile thread loop, said conveying means receives two of said at least one support fabric web, the two support fabric webs held taut with a distance apart equal to a sum of individual pile heights; and a cutting means is positioned at a delivery end of said conveying means between the two support fabric webs for cutting said pile thread loop so as to separate the support fabric webs, wherein each tufting needle bar possesses at least one row of tufting needles extending obliquely in relation to the direction of web conveyance with said plurlity of tufting needles arranged obliquely one behind the other, and wherein a common engagement member of the loop holding means is associated with each such row of tufting needles, a stroke of said engagement member in a longitudinal direction of the row being at least equal to a length of an associated tufting needle row.

2. The apparatus as claimed in claim 1, wherein a plurality of evenly staggered parallel tufting needle rows are received on a common tufting needle bar.

3. The apparatus as claimed in claim 1, wherein at least one tufting needle bar extending over the width of the web is provided with a plurality of tufting needle rows distributed evenly over the length thereof.

4. The apparatus as claimed in claim 3, wherein the inclination of the tufting needle rows in relation to the direction of conveying of the web is equal to 45°.

5. The apparatus as claimed in claim 1; wherein the engagement member associated with one respective tufting needle row is in the form of a lance parallel to the support fabric webs and extending in the longitudinal direction of the rows.

6. The apparatus as claimed in claim 3, wherein a plurality of engagement members are arranged adjacent to each other and are received on a common bar extending across the direction of conveying of the web, said bar is guided for movement in a longitudinal direction of the rows.

7. The apparatus as claimed in claim 6, wherein the bar is driven by an eccentric drive and is guided in a longitudinal guide extending in the longitudinal direction of the rows.

8. The apparatus as claimed in claim 6, comprising a bar extending continuously over the width of the web.

9. The apparatus as claimed in claim 1, wherein said engagement member carries one binding thread and a binding thread catcher said catcher being arranged adjacent to a front dead center position of a front end of said engagement member.

10. The apparatus as claimed in claim 9, wherein said engagement member carries one binding thread and is designed in the form of a needle-shaped lance with a respective front end eye.

11. The apparatus as claimed in claim 9, wherein a plurality of such binding thread catchers arranged adjacent to one another are mounted on a common carrier.

12. The apparatus as claimed in claim 11, wherein the carrier is designed so as to extend over the width of the web.

13. The apparatus as claimed in claim 9, wherein each binding thread catcher is a hook and is mounted on a carrier in the form of a rockable shaft.

14. The apparatus as claimed in claim 9, wherein the binding thread catcher deflects a front end of the binding thread transversely to a longitudinal direction of the tufting needle row during an advance step of the support fabric web.

* * * * *